US010808389B2

(12) United States Patent
El Halabi Sirdar et al.

(10) Patent No.: US 10,808,389 B2
(45) Date of Patent: Oct. 20, 2020

(54) DEVICE FOR ADAPTING A FLUSHER FOR TOILET TANKS TO A BASE OF A VALVE WITH LATERAL OVERFLOW PIPE

(71) Applicant: H & H Idrospania Technic, S.L., Burriana (ES)

(72) Inventors: Naji El Halabi Sirdar, Burriana (ES); José Mario Quesada Martinez, Burriana (ES)

(73) Assignee: H & H Idrospania Technic, S.L., Burriana (ES)

( * ) Notice: Subject to any disclaimer, the term of this patent is extended or adjusted under 35 U.S.C. 154(b) by 0 days.

(21) Appl. No.: 16/275,548

(22) Filed: Feb. 14, 2019

(65) Prior Publication Data

US 2020/0263406 A1 Aug. 20, 2020

(51) Int. Cl.
*E03D 5/01* (2006.01)

(52) U.S. Cl.
CPC ..... *E03D 5/01* (2013.01)

(58) Field of Classification Search
CPC ..... E03D 5/01
USPC ..... 4/325
See application file for complete search history.

(56) References Cited

U.S. PATENT DOCUMENTS 8,230,532 B2 * 7/2012 Htay ..... E03D 1/306 4/392

* cited by examiner

*Primary Examiner* — Lori L Baker
(74) *Attorney, Agent, or Firm* — Richard M. Goldberg

(57) ABSTRACT

A device for adapting a flusher for toilet tanks to a flush valve base provided with a lateral overflow pipe, includes a fastening element for fastening to the overflow pipe, the fastening element having a ring or cylinder shape with a low height and which includes a pair of cut-outs able to house lugs arranged in the overflow pipe; and a support element of a casing of a flusher of toilet tanks, including a fastening arrangement with the casing of the flusher, and may include a part for adapting the diameter of the fastening element to the diameter of the overflow pipe.

7 Claims, 2 Drawing Sheets

DEVICE FOR ADAPTING A FLUSHER FOR TOILET TANKS TO A BASE OF A VALVE WITH LATERAL OVERFLOW PIPE

BACKGROUND OF THE INVENTION

The present invention relates to a device for adapting a flusher for toilet tanks, particularly to a valve base provided with a lateral overflow pipe.

STATE OF THE ART

The need to save water consumption in recent times has caused technological developments to evolve so that the flushers for toilets have a controlled flush or a double flush, which will be actuated depending on the needs of the user. However, formerly, simple flush mechanisms were common.

The simple flush tanks drain one same amount of water each time without the type of waste needing to be eliminated mattering. In this type of tank, the volume of water that is flushed cannot be adjusted, or it will depend on the time that user keeps the opening device actuated. One type of flush valve for simple flush tanks is made up of a valve base which is housed in the flush hole of the tank and is fastened thereto, said base defining a flush conduit through which the water passes during the emptying of the tank. This valve base further comprises a flapper which blocks said flush conduit. The flapper is articulated in an overflow pipe, arranged on one side of the valve base, the vertical axis of the overflow pipe being eccentric to the vertical axis of the flush conduit defined by the valve base. The lower end of the overflow pipe connects to the flush conduit in a portion lower than the portion wherein the flapper is arranged. When said flapper is pulled by means of a chain joined to an actuation mechanism (usually a lever, pull element, button, etc.) the valve opens and the emptying of the tank is enabled.

As mentioned, the problem of the flush valves described in the previous paragraph is that they do not enable the volume of flush water to be regulated.

When a simple flush mechanism is to be substituted with a flusher of the type comprising regulation means for the flush volume, such as controlled flush or double button, the passage of water must be cut off, the tank must be removed, emptied of water, the valve base provided with a lateral overflow pipe must be removed and then the new flusher mechanism is installed.

The present invention provides a device for adapting a flusher mechanism to a flush valve with an overflow pipe, which enables the flusher to be installed without needing to disassemble the tank or remove the valve base with a lateral overflow pipe.

SUMMARY OF THE INVENTION

The present invention, as explained previously, provides a device for adapting a flusher for toilet tanks to a valve base provided with a lateral overflow pipe, with the aim of preventing the tank from needing to be disassembled for the installation of the new flusher mechanism, thereby using the advantages of the flushers provided with a regulation mechanism for the flush volume.

The flush valves for simple flush tanks whereon the device for adapting flushers of toilet tanks object of the present invention is assembled comprise, as explained previously, a valve base provided with a lateral overflow pipe, said lateral overflow pipe being provided with a pair of lugs in opposite positions in a section of the lateral overflow pipe whereon a flapper joined to a chain is articulated, wherein when said chain is pulled by means of an actuation mechanism the flapper is lifted and the valve for the outlet of water from the tank is opened.

When a flusher for toilet tanks of the type comprising regulation means for the flush volume is to be assembled, the valve base provided with a lateral overflow pipe must be substituted, the tank needing to be disassembled to do so.

The device for adapting a flusher for toilet tanks object of the present invention enables a flusher of the type mentioned in the previous paragraph to be assembled on the valve base provided with a lateral overflow pipe, only disassembling the flapper of said valve.

The flushers of toilet tanks comprising regulation means for the flush volume are normally made up of: a support base that is assembled on the tank; a casing that is fastened to said support base; a flush mechanism comprising a flapper of the flush hole, said flapper being mobile with respect to the casing; and an actuation mechanism that actuates the flush mechanism by means of the action on a button or lever arranged in the outer portion of the tank.

The device for adapting to the type of tank described mainly comprises two elements.

An element for fastening to the lateral overflow pipe. Said element has the shape of a ring or cylinder with a low height, for example between 0.5 and 3 cm, and is inserted from the upper portion of the overflow pipe. The inner diameter of the fastening element is substantially the same as the outer diameter of the overflow pipe, such that once it is inserted there is no rocking between both elements. If the inner diameter of the fastening element is greater than the outer diameter of the lateral overflow pipe, which can happen when the device object of the present invention is to be adapted to overflow pipes with different cross sections, a supplementary element can be added which is arranged on the inner face of the fastening element and adapts the inner diameter of the assembly of the fastening element and accessory to the outer diameter of the overflow pipe. The fastening element further comprises a pair of cut-outs corresponding to a pair of lugs arranged in the lateral overflow pipe used as an articulation element for the flapper in the simple flush valves. According to an optional embodiment, said cut-outs comprise a divergent mouth such that when it is arranged on the lug it is automatically positioned for an easy insertion of the lug. The cut-out further comprises a cavity with a greater diameter than the rest of the cut-out for the housing of the lug. The fastening part is made of a material that is completely or partially elastic which enables the lug to slightly deform the cut-out before being inserted into the cavity.

A support element of the flusher to be placed is made up of a body joined to the insertion element in the overflow pipe. The body comprises an upper edge that is equipped with the elements for fastening to the casing of the flusher. According to an optional embodiment, these fastening elements are made up of a set of protuberances arranged on the upper edge of the support element of the flusher which define a housing for the insertion of pivots arranged in the inner face of the casing of the flusher that is to be assembled, inserting said pivots into the housings by means of the rotation between the casing and the support elements.

The fastening element of the overflow pipe and the support element of the flusher are preferably made of a single part, although they can be made up of two parts, said parts comprising fastening means between them.

BRIEF DESCRIPTION OF THE DRAWINGS

With the aim of illustrating the explanation that follows, we have attached two sheets of drawings to the present specification wherein three figures represent, by way of example and without limiting character, the present invention according to a particular embodiment, and wherein.

Figure 1:
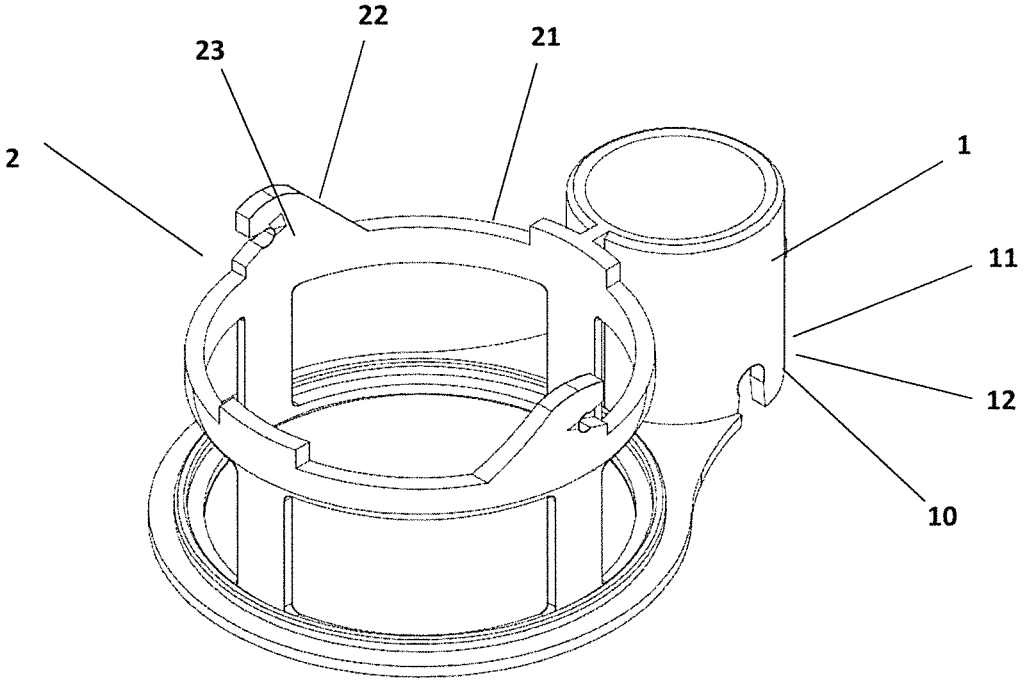
FIG. 1 shows a perspective view of the device for adapting a flusher for toilet tanks to a flush valve provided with an overflow pipe, according to an embodiment of the present invention.

In said figures we can see the following reference signs:

1 Fastening element
10 Cut-out
11 Housing for the lugs
12 Mouth
2 Support element
21 Upper edge of the support element
22 Protuberances
23 Housing for pivot of the casing of the flusher
3 Part for joining to the tank of the simple flush valve
4 Overflow pipe
5 Lug

DETAILED DESCRIPTION OF THE PREFERRED EMBODIMENTS OF THE INVENTION

In view of the aforementioned figures and, in accordance with the numbering adopted, an example of a preferred embodiment of the invention can be observed therein, which comprises the parts and elements indicated and described in detail below.

Figure 2:
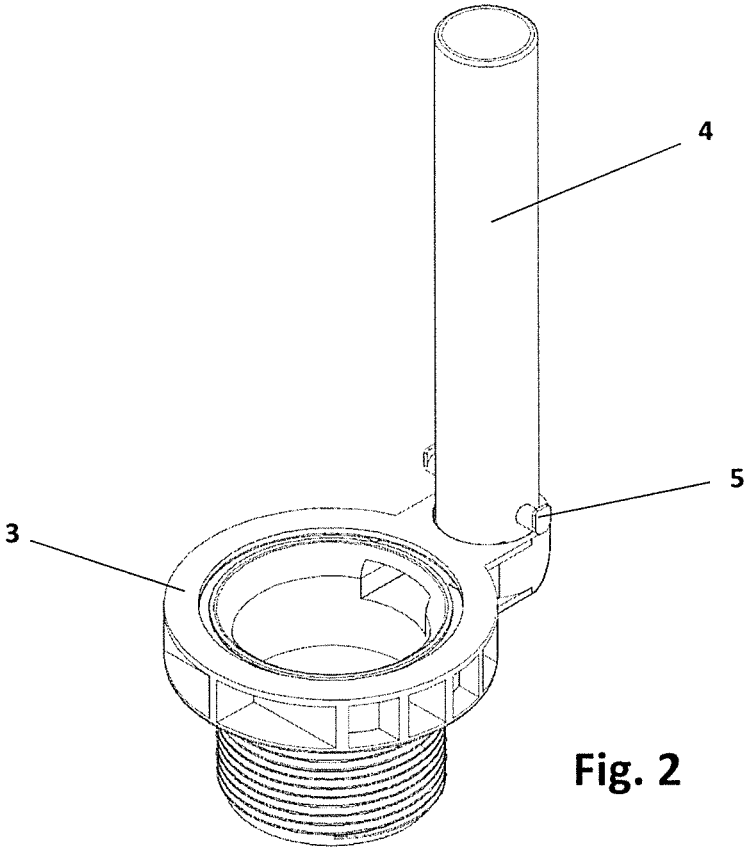
FIG. 2 shows a perspective view of the valve base provided with a lateral overflow pipe whereon the device for adapting flushers of toilet tanks object of the present invention is assembled.
Figure 3:
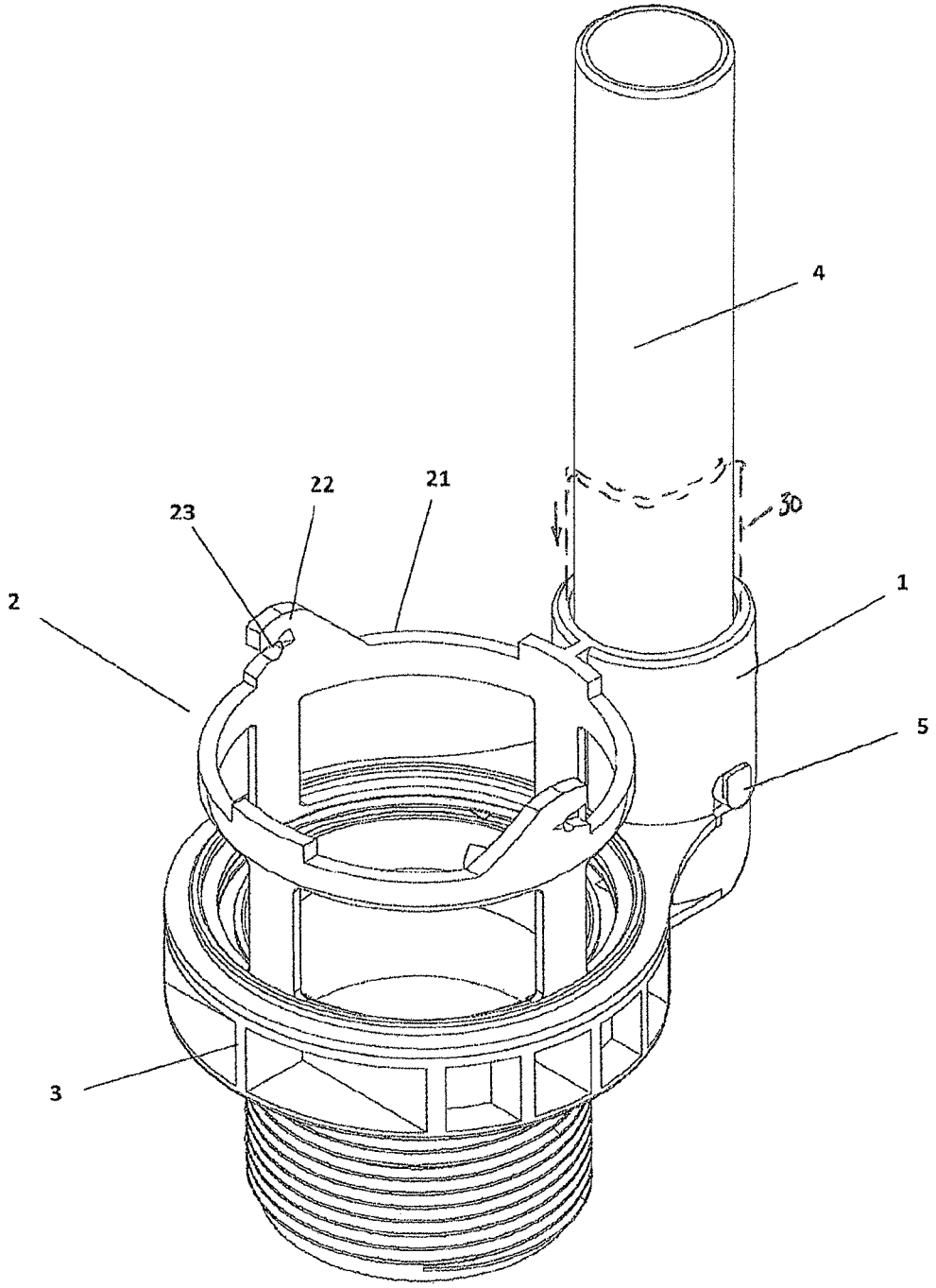
FIG. 3 shows a perspective view of the device for adapting flushers of toilet tanks assembled on the flush valve provided with an overflow pipe.

Thus, as seen in FIGS. 1 to 3, a possible preferred embodiment of the device for adapting a toilet tank flusher to a flush valve provided with an overflow pipe comprises, essentially, the following elements:

An element (1) for fastening to the overflow pipe, which has a ring or cylinder shape with a low height, and which comprises a pair of cut-outs (10) able to house lugs (5) arranged in the overflow pipe (4).

A support element (2) of a casing of a toilet tank flusher, comprising means of fastening with the casing of said flusher.

The cut-outs (10) of the fastening element (1) comprise a divergent mouth (12), in order to enable the automatic positioning of the lug in the cut-out, and it further comprises a bulge in the inner end thereof which defines a housing (11) of the lugs (5) arranged in the overflow pipe (4). In order for the lug to be able to partially deform the cut-out before being inserted into the housing (11), the fastening element is made of an elastic material.

The support element (2) forms a single body together with the fastening element (1), and comprises a lower edge which rests on the part (3) for joining to the tank of the simple flush valve, and an upper edge (21) comprising an assembly of protuberances (22) which define a housing (23) for the insertion of pivots arranged on the inner face of the casing of the flusher that is to be assembled, said pivots being inserted into the housings (23) by means of the relative rotation between the casing and the support element (2).

A supplementary element 30 can be added which is arranged on the inner face of the fastening element 1 and adapts the inner diameter of the fastening element 1 to the outer diameter of the overflow pipe 4. Thus, the supplementary element 30 is positioned between the inner diameter of the fastening element 1 and the outer diameter of the overflow pipe 4.

The flapper of the body of the axial-type flusher, therefore, will be able to produce the blockage by means of it resting on the membrane of the pre-existing base, and the opening by means of the vertical elevation thereof, for example, by means of actuation by a button, using the advantages of other types of flushers.

What is claimed is:

1. A device for adapting a flusher for toilet tanks to a flush valve base provided with a lateral overflow pipe, comprising:

a fastening element for fastening to the overflow pipe, the fastening element having a ring shape, and which comprises a pair of cut-outs adapted to house lugs arranged in the overflow pipe; and a support element adapted to support a casing of a flusher for toilet tanks, the support element comprising a fastening arrangement adapted to fasten with the casing of the flusher, the support element connected with the fastening element;

wherein the cut-outs of the fastening element comprise a divergent mouth.

2. The device for adapting a flusher for toilet tanks to a flush valve provided with a lateral overflow pipe, according to claim 1, wherein the fastening element is made of an elastic material.

3. A device for adapting a flusher for toilet tanks to a flush valve base provided with a lateral overflow pipe, comprising:

a fastening element for fastening to the overflow pipe, the fastening element having a ring shape, and which comprises a pair of cut-outs adapted to house lugs arranged in the overflow pipe; and a support element adapted to support a casing of a flusher for toilet tanks, the support element comprising a fastening arrangement adapted to fasten with the casing of the flusher, the support element connected with the fastening element;

wherein each cut-out of the fastening element comprises a bulge which defines a housing for a said lug arranged in the lateral overflow pipe.

4. A device for adapting a flusher for toilet tanks to a flush valve base provided with a lateral overflow pipe, comprising:

a fastening element for fastening to the overflow pipe, the fastening element having a ring shape, and which comprises a pair of cut-outs adapted to house lugs arranged in the overflow pipe; and a support element adapted to support a casing of a flusher for toilet tanks, the support element comprising a fastening arrangement adapted to fasten with the casing of the flusher, the support element connected with the fastening element;

wherein the fastening arrangement of the support element includes a set of protuberances arranged at an upper edge of the support element which define housings adapted to house pivots arranged on an inner face of the casing of the flusher.

5. The device for adapting a flusher for toilet tanks to a flush valve provided with a lateral overflow pipe, according to claim 1, wherein the fastening element and the support element form a single part.

6. The device for adapting a flusher for toilet tanks to a flush valve provided with a lateral overflow pipe, according to claim 1, wherein the fastening element and the support element are two different parts with a fastening assembly connecting them together.

7. The device for adapting a flusher for toilet tanks to a flush valve provided with a lateral overflow pipe, according to claim 1, further comprising a supplementary part positioned between the inner diameter of the fastening element and the outer diameter of the overflow pipe.

* * * * *